US011982452B2

(12) United States Patent
Goel

(10) Patent No.: US 11,982,452 B2
(45) Date of Patent: May 14, 2024

(54) TEMPERATURE DIFFERENCE SENSOR FOR HVAC SYSTEMS

(71) Applicant: Lennox Industries Inc., Richardson, TX (US)

(72) Inventor: Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 545 days.

(21) Appl. No.: 16/438,946

(22) Filed: Jun. 12, 2019

(65) Prior Publication Data

US 2020/0393151 A1 Dec. 17, 2020

(51) Int. Cl.

| | |
|---|---|
| ***F24F 11/30*** | (2018.01) |
| ***F24F 11/89*** | (2018.01) |
| ***F25B 40/02*** | (2006.01) |
| ***F25B 49/02*** | (2006.01) |

(52) U.S. Cl.

CPC ..... *F24F 11/30* (2018.01); *F24F 11/89* (2018.01); *F25B 40/02* (2013.01); *F25B 49/02* (2013.01); *F25B 2500/19* (2013.01); *F25B 2600/05* (2013.01); *F25B 2600/19* (2013.01); *F25B 2700/04* (2013.01);

(Continued)

(58) Field of Classification Search

CPC . F24F 11/30; F24F 11/89; F25B 49/02; F25B 40/02; F25B 2500/19; F25B 2700/21175; F25B 2600/05; F25B 2700/04; F25B 2700/21163; F25B 2700/21174; F25B 2600/19

See application file for complete search history.

(56) References Cited

U.S. PATENT DOCUMENTS 4,527,399 A * 7/1985 Lord ..... F25B 41/31 62/212
2005/0204756 A1* 9/2005 Dobmeier ..... F25B 49/005 62/149

(Continued)

FOREIGN PATENT DOCUMENTS

SU 541076 A1 * 12/1976

OTHER PUBLICATIONS

Lobov, Evaporating Automatic Charging, Dec. 30, 1976, SU541076A1, Whole Document (Year: 1976).*

*Primary Examiner* — Larry L Furdge
(74) *Attorney, Agent, or Firm* — Baker Botts L.L.P.

(57) ABSTRACT

A condenser coil of a system includes a subcool sensor. The subcool sensor includes a first thermistor positioned to sense a saturated liquid temperature of refrigerant flowing in a first portion of the condenser coil. The subcool sensor includes a second thermistor positioned to sense a liquid temperature of the refrigerant flowing in a second portion of the condenser coil. The second thermistor is coupled electronically in series with the first thermistor. The subcool sensor includes a signal output for transmitting a subcool signal from the subcool sensor. The signal output is coupled electronically to a first terminal of the first thermistor and a second terminal of the second thermistor. A controller of the system includes an input/output interface which receives the subcool signal from the subcool sensor and determines a temperature difference between the saturated liquid temperature and the liquid temperature based on the subcool signal.

20 Claims, 5 Drawing Sheets

(52) U.S. Cl.
CPC ..... *F25B 2700/21163* (2013.01); *F25B 2700/21174* (2013.01); *F25B 2700/21175* (2013.01)

(56) References Cited

U.S. PATENT DOCUMENTS

| | | | | |
|---|---|---|---|---|
| 2006/0112702 | A1* | 6/2006 | Martin | B60H 1/00378 62/180 |
| 2009/0126375 | A1* | 5/2009 | Toyoshima | F25B 13/00 62/77 |
| 2015/0261233 | A1* | 9/2015 | Duan | G09G 3/3655 345/101 |

* cited by examiner

TEMPERATURE DIFFERENCE SENSOR FOR HVAC SYSTEMS

TECHNICAL FIELD

This disclosure relates generally to heating, ventilation, and air conditioning (HVAC) systems and methods of their use. In particular, this disclosure relates to a temperature difference sensor for HVAC systems.

BACKGROUND

Heating, ventilation, and air conditioning (HVAC) systems are used to regulate environmental conditions within an enclosed space. Typically, HVAC systems include both an evaporator coil and a condenser coil. A blower of the HVAC system pulls warm air from the enclosed space and pushes the air across the evaporator coil to cool the air. The air is cooled via heat transfer with refrigerant flowing through the evaporator coil and returned to the enclosed space as conditioned air. Meanwhile, the refrigerant flowing through the evaporator coil is heated and generally transitions to the vapor phase. After being pressurized by a compressor, the heated vapor-phase refrigerant from the evaporator coil flows to the condenser coil where it is cooled and returned to a liquid state before flowing back to the evaporator coil to repeat the cycle. The temperature of the refrigerant flowing through the evaporator coil and the condenser coil can have an impact on HVAC system performance.

SUMMARY OF THE DISCLOSURE

As described above, the temperature of the refrigerant flowing through the evaporator coil and the condenser coil can impact HVAC system performance. More particularly, temperature differences between the refrigerant flowing in different portions, or regions of these coils, can be used as a metric of the performance of the HVAC system or can indicate that maintenance (e.g., charging of the system with refrigerant) is required. One such temperature difference is the "superheat," or the temperature difference between the temperature of the superheated vapor refrigerant and the saturation temperature of the refrigerant flowing through an evaporator coil of the HVAC system. Another example is the "subcool," or the temperature difference between the saturation temperature of the refrigerant and the temperature of the subcooled liquid refrigerant flowing through a condenser coil of the HVAC system.

Conventionally, a temperature difference (such as "superheat" and "subcool") is measured using two temperature sensors positioned at appropriate locations in the HVAC system. A controller generally receives, via an appropriate input interface, a signal from each sensor, and processing circuitry of the controller calculates the temperature difference using the temperatures measured by each sensor. For example, a temperature sensor may be disposed in a portion of the coil that has saturated liquid flowing therethrough (e.g., near the input or center of the coil), while another temperature sensor is disposed near the outlet of the evaporator coil. A temperature signal from each sensor is received by a controller of the HVAC system, and the superheat value is determined from the difference of the temperatures measured from these two signals. A similar approach can be used to measure the temperature difference between saturated liquid refrigerant and subcooled refrigerant in the condenser coil of the HVAC system.

This disclosure encompasses the recognition of problems of conventional approaches to measuring temperature differences in HVAC systems, such as those described above. In particular, the present disclosure encompasses the recognition that it may be impractical or prohibitively expensive to employ the large number of conventional sensors required to measure superheat and subcool in HVAC systems, particularly as the size and complexity of the HVAC system increases. For instance, HVAC systems increasingly include multi-circuited evaporator coils and condenser coils, such that each circuit uses not only two sensors to measure the corresponding temperature difference (subcool or superheat) but also the requisite controller hardware for receiving and processing each of the signals from these sensors. For example, for conventional temperature difference measurements, at least two signal inputs and the requisite interface hardware and circuitry for communicating and processing these signals are required for each evaporator and condenser circuit. Thus, an HVAC system with an evaporator coil and condenser coil that each have four circuits would use sixteen temperature sensors and a controller capable of receiving and processing sixteen temperature signals. Controller hardware can become prohibitively expensive and complex to manufacture and program as the number of signal inputs increases.

This disclosure contemplates an unconventional dual-thermistor sensor with a single signal output that provides a technical solution to the technical problems of conventional systems, including those described above. The sensor can be disposed in an HVAC system for example to measure superheat, subcool, or any other relevant temperature difference related to performance of the HVAC system. A system of the present disclosure, in certain embodiments, includes a first thermistor positioned to sense a saturated liquid temperature of the refrigerant flowing in a first portion of a condenser coil, a second thermistor sensor positioned to sense a liquid temperature of refrigerant flowing in a second portion of the condenser coil. The second thermistor is coupled electronically in series with the first thermistor, and the signal output of the temperature difference sensor is coupled to a terminal of the first thermistor and a terminal of the second thermistor. The signal output facilitates transmission of a temperature difference signal from the sensor.

The systems of the present disclosure provide an improvement to the technology used to measure temperature differences in HVAC systems. For example, the temperature difference sensor facilitates the accurate measurement of a temperature difference based on the temperature difference signal from the sensor, rather than relying on two temperature signals, each from a separate temperature sensor. As such, temperature differences may be measured using fewer electronic signals than was previously possible. The temperature difference sensor may be integrated into a practical application to measure temperature differences in HVAC systems, for example, where the availability of signal input/out output and signal processing hardware for receiving and processing signals may be limited (e.g., due to cost and/or size constraints).

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 6 of the drawings, like numerals being used for like and corresponding parts of the various drawings.

As used in the present disclosure, a "saturated liquid" refers to a fluid in the liquid state that is in thermodynamic equilibrium with the vapor state of the fluid for a given pressure. A "saturated liquid" is said to be at the saturation temperature for a given pressure. If the temperature of a saturated liquid is increased above the saturation temperature, the saturated liquid generally begins to vaporize. A "superheated vapor" refers to a fluid in the vapor state that is heated to a temperature that is greater than the saturation temperature of the fluid at a given pressure. A "subcooled liquid" refers to a fluid in the liquid state that is cooled below the saturation temperature of the fluid at a given pressure.

Temperature Difference Sensor

Figure 1:
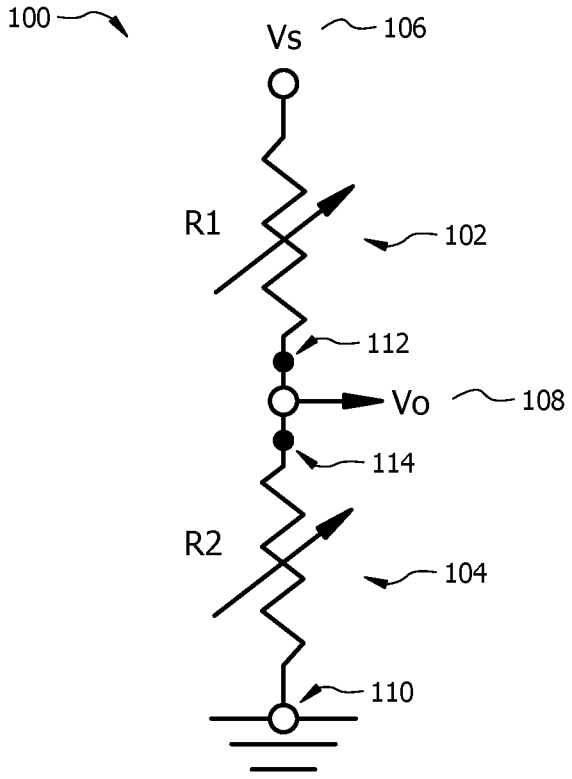
FIG. 1 is a circuit diagram of an example temperature difference sensor.

FIG. 1 is a circuit diagram of an example temperature difference sensor 100. The temperature difference sensor 100 includes a first temperature sensing element 102, a second temperature sensing element 104, a supply voltage input 106, a signal output 108, and a connection 110 for an electrical ground. The signal output 108 is electronically coupled to a terminal 112 of the first temperature sensing element 102 and to a terminal 114 of the second temperature sensing element 104, as illustrated in FIG. 1. Each of temperature sensing elements 102 and 104 is generally a thermistor and are arranged in series as shown in FIG. 1. For example, each thermistor may have a resistance of about 10 kilo-ohm at room temperature (i.e., at about 77° F.). The resistance of the thermistor changes as a function of temperature, generally in a logarithmic fashion. The resistance of the thermistor generally decreases with increasing temperature.

In contrast to the temperature difference sensor 100, a conventional temperature sensor employs only a single thermistor rather than the two (thermistors 102 and 104) shown in FIG. 1. In a conventional temperature sensor, rather than including the second thermistor 104, a constant resistance resistor (i.e., a temperature-insensitive resistor) is used. An analysis of the circuit shown in FIG. 1 shows that, if thermistor 102 has a first resistance R1 at a first temperature and thermistor 104 has a second resistance (R2) at a second temperature, the ratio of these resistance values (R1/R2) can be expressed in terms of the measured voltage output signal (Vo) and the supply voltage (Vs) applied to the sensor 100 such that R1/R2=(Vs/Vo−1). Accordingly, this circuit analysis indicates that measuring the output voltage (Vo) provides a measure of a ratio of temperatures via the resistance ratio of the two thermistors 102 and 104 (i.e., R1/R2). Prior to the present disclosure, two thermistors arranged as shown in FIG. 1 would not have had a reasonable likelihood of successfully being used to measure a temperature difference (i.e., rather than a temperature ratio), as would be appreciated by one of ordinary skill in the art. The present disclosure encompasses the recognition of the new and unexpected result that the two-thermistor arrangement of temperature difference sensor 100 shown in FIG. 1 can be used to accurately measure a temperature difference.

As described in greater detail below, the temperature difference sensor 100 presents several technical advantages that improve the operation of HVAC systems. For example, subcool can be measured for each condenser coil using a single signal (rather than the two required for conventional temperature difference measurements), thereby decreasing the signal input requirements for the hardware controllers by a factor of two. This can reduce or eliminate the need for expensive input interfaces for controllers in HVAC systems with multi-circuited coils while also freeing up controller inputs and processing resources for other HVAC monitoring and optimization tasks. For instance, superheat and subcool signals received from the sensors can be used, individually or collectively, to detect loss of charge in the HVAC system. The superheat and/or subcool signals can also be used as a metric for optimizing the settings of variable speed components of the HVAC system such as a variable speed blower, variable speed compressor, and/or variable speed outdoor fan (e.g., of a condenser unit).

HVAC System

Figure 2:
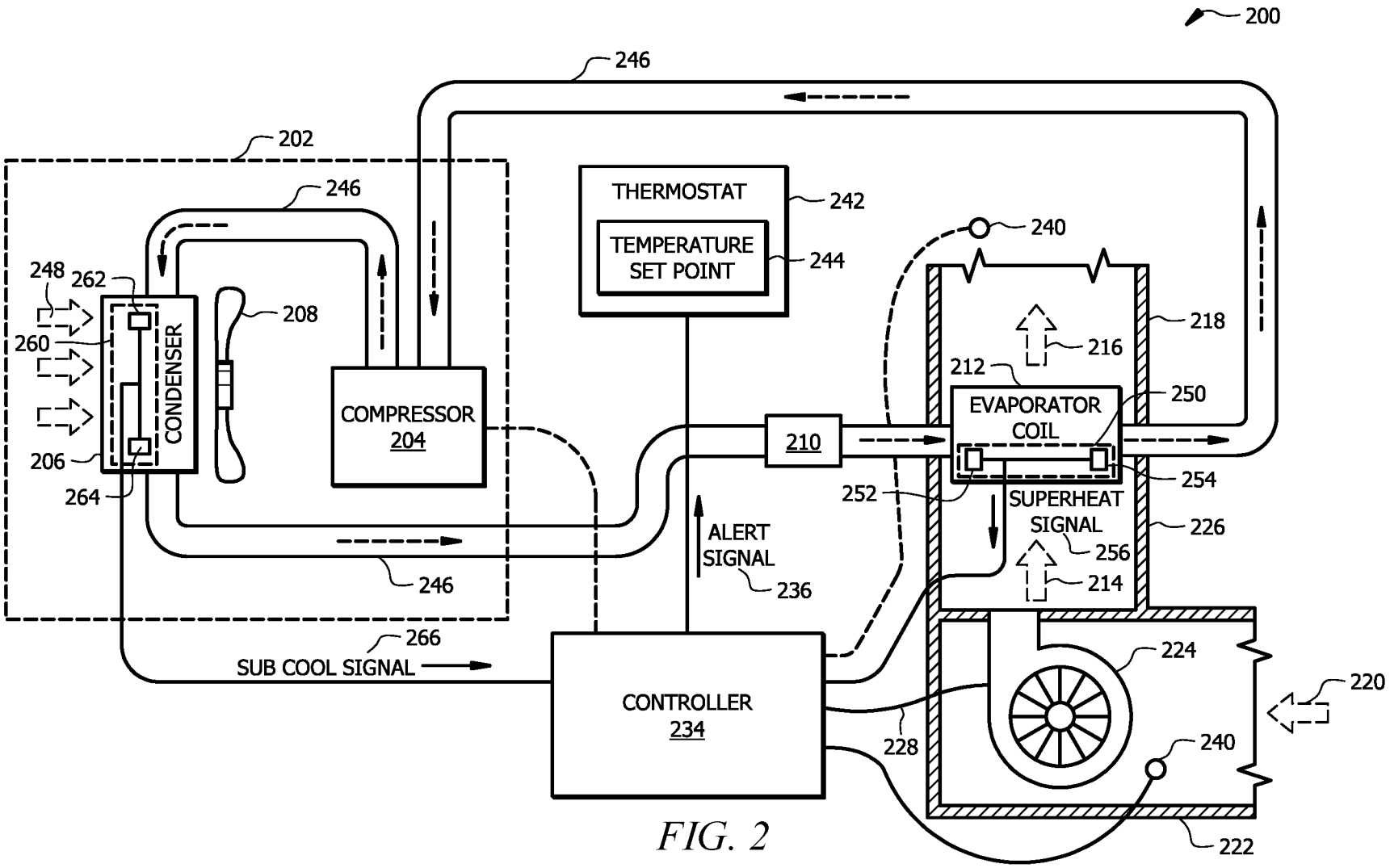
FIG. 2 is a diagram of a an HVAC system comprising temperature difference sensors as illustrated in FIG. 1.

FIG. 2 is a schematic diagram of an embodiment of an HVAC system 200 comprising temperature difference sensors 250 and 260, which are each configured according to the circuit diagram of FIG. 1. The HVAC system 200 conditions air for delivery to a conditioned space. The conditioned space may be, for example, a room, a house, an office building, a warehouse, or the like. In some embodiments, the HVAC system 200 is a rooftop unit (RTU) that is positioned on the roof of a building and the conditioned air is delivered to the interior of the building. In other embodiments, a portion of the system may be located within the building and another portion outside the building. The HVAC system 200 may also include heating elements, which are not shown here for convenience and clarity. The HVAC system 200 may be configured as shown in FIG. 2 or in any other suitable configuration. For example, the HVAC system 200 may include additional components or may omit one or more components shown in FIG. 2.

The HVAC system 200 comprises a condensing unit 202, a metering device 210, an evaporator coil 212, a controller 234, a thermostat 242, and a refrigerant conduit subsystem 246. The refrigerant conduit subsystem 246 is operable to move a refrigerant through a cooling cycle (i.e., in a cycle through the evaporator coil 212, the condensing unit 202, and the metering device 210). The refrigerant may be any acceptable refrigerant including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

In some embodiments, the condensing unit 202 comprises a compressor 204, a condenser coil 206, and a fan 208. The compressor 204 is coupled to the refrigerant conduit subsystem 246 that compresses the refrigerant. In some embodiments, a compressor 204 may be configured to operate at multiple speeds or as a variable speed compressor. For example, the compressor 204 may be configured to operate at multiple predetermined speeds. In some embodiments, the compressor 204 is in signal communication with a controller 234 using a wired or wireless connection. The controller 234 is configured to provide commands or signals to control the operation of the compressor 204. For example, the controller 234 is configured to send signals to turn on or off one or more compressors 204 and/or to control the speed of the compressor 204. Additional information about the controller 234 is described below with respect to FIG. 6.

The condenser coil 206 is downstream of the compressor 204 and configured for transferring heat from the refrigerant flowing through the condenser coil 206. The fan 208 is configured to move air 248 across the condenser coil 206. For example, the fan 208 may be configured to blow outside air across the condenser coil 206 (i.e., across the outer surface of the condenser coil 206) to help cool the refrigerant flowing therethrough. The compressed, cooled refrigerant from the condenser coil 206 flows downstream to an expansion device 210, or metering device. The fan 208 may be communicatively coupled via wired or wireless communication to the controller 234 so that the controller 234 may be used to adjust the speed of the fan 208.

The condenser coil 206 includes a first temperature difference sensor 260. The first temperature difference sensor 260 includes a first thermistor 262 and a second thermistor 264. Each of these thermistors 262, 264 is disposed at a different location along the length of the condenser coil 206 such that a temperature difference of refrigerant is measured between refrigerant in the appropriate thermodynamic states within the condenser coil 206. The first thermistor 262 is positioned to sense a temperature of the saturated liquid refrigerant, while the second thermistor 264 is positioned to sense a temperature of the subcooled liquid refrigerant. The first temperature difference sensor 260 is in signal communication with a controller 234 using a wired or wireless connection.

Figure 3:
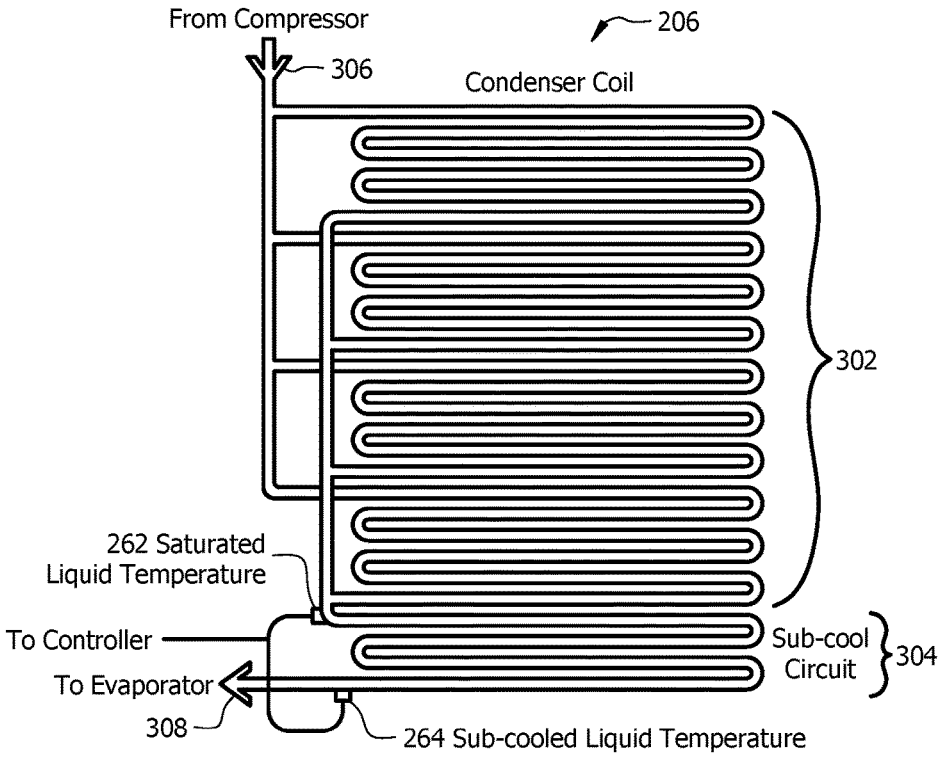
FIG. 3 is a diagram of an example condenser coil of the HVAC system illustrated in FIG. 2.

FIG. 3 shows an example of the condenser coil 206 in greater detail with thermistors 262 and 264 disposed on different portions of the condenser coil 206. Each thermistor 262, 264 may be attached to or disposed on or within the condenser coil 206 via any appropriate means (e.g., attached to an internal or exterior surface of the coil 206). The first thermistor 262 is disposed on a first portion 302 of the coil 206 with a refrigerant flowing therethrough at the saturation temperature of the refrigerant (e.g., a saturated liquid refrigerant). For example, the first thermistor 262 may be placed at or near the end of the initial section 302 of the condenser coil 206 and typically before the start of any subcool coil section 304 of the condenser coil 206. For instance, the first thermistor 262 may be placed within a predefined distance (e.g., of between 0 and 36 inches) from an inlet 306 of the condenser coil 206. The second thermistor 264 is disposed on a second portion 304 of the coil 206 with a subcooled liquid refrigerant flowing therethrough. For example, the second thermistor 264 may be placed at or near the outlet 308 of the condenser coil 206, or at or near the end of a subcool portion 304 of the condenser coil 206 (as shown in FIG. 3). For instance, the second thermistor 264 may be placed within a predefined distance (e.g., of between 0 and 36 inches) from the outlet 308 of the condenser coil 206, or within a predefined distance (e.g., of between 0 and 36 inches) from the end of a subcool portion 304 of the condenser coil 206.

The first thermistor 262 may be electronically coupled to a supply voltage (e.g., with a corresponding of Vs in FIG. 1), while a signal output (e.g., corresponding to output 108 of FIG. 1) is communicatively coupled to the controller 234 between the first and second thermistors 262 and 264. The supply voltage (e.g., corresponding to voltage 106 of FIG. 1) may be supplied by a battery or any other suitable electrical power source. The signal 266 transmitted to the controller 234 is referred to herein as a "subcool signal," and may be used to determine one or both of (1) the difference between the temperature of saturated liquid refrigerant in the condenser coil 206 (i.e., the saturation temperature of the refrigerant) and the temperature of subcooled liquid in the condenser coil 206; and (2) whether a loss of charge has or may have occurred in the HVAC system (e.g., as described in greater detail with respect to FIG. 5 below).

Referring again to FIG. 2, the evaporator coil 212 facilitates heat transfer between airflow 214 across the evaporator coil 212 (i.e., when the airflow 214 contacts an outer surface of the evaporator coil 212) and refrigerant passing through the interior of the evaporator coil 212. The evaporator coil 212 is fluidically connected to the compressor 204, such that refrigerant flows from the evaporator coil 212 to the compressor 204. The evaporator coil 212 includes a second temperature difference sensor 250 with a first thermistor 252 and a second thermistor 254. Each of these thermistors 252, 254 is disposed at a different location along the length of the evaporator coil 212 such that a temperature difference is measured between refrigerant in the appropriate thermodynamic states for measurement of superheat. The first thermistor 252 is positioned to sense a temperature of the saturated liquid refrigerant, while the second thermistor 254 is positioned to sense a temperature of the superheated vapor refrigerant. The second temperature difference sensor 250 is in signal communication with controller 234 using a wired or wireless connection.

Figure 4:
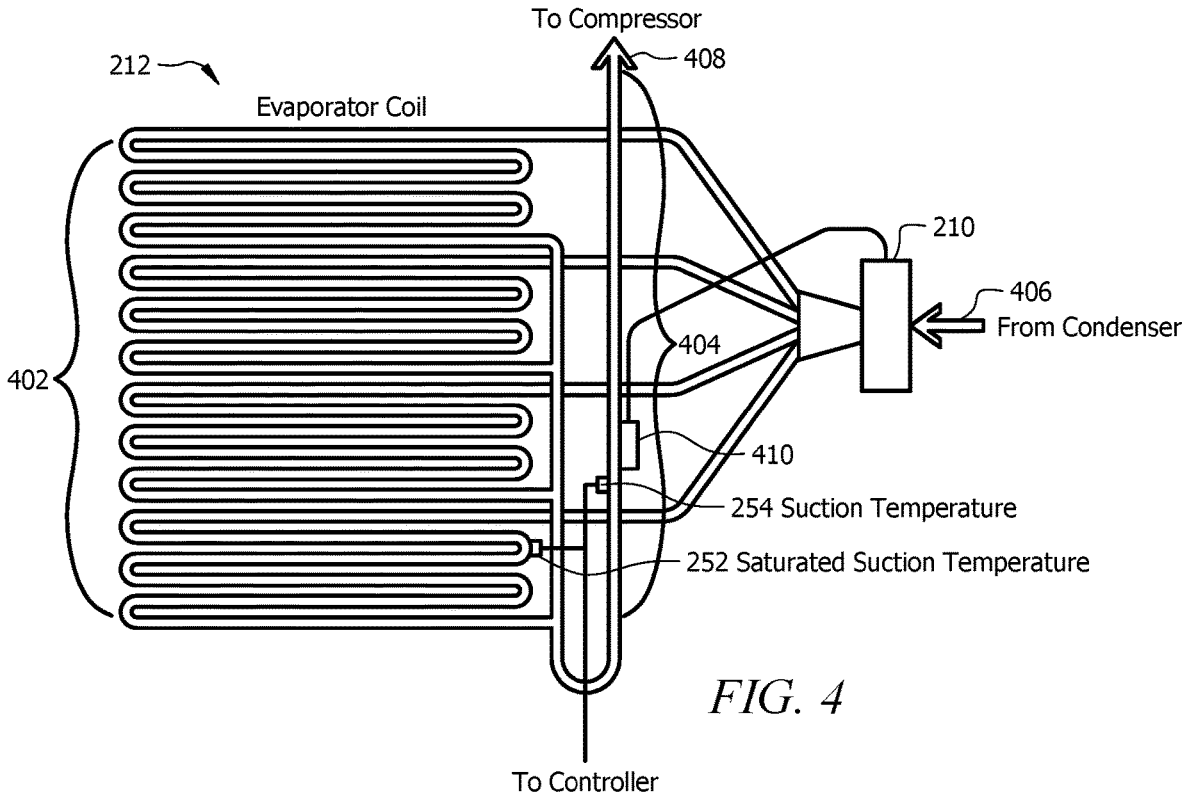
FIG. 4 is a diagram of an example evaporator coil of the HVAC system illustrated in FIG. 2.

FIG. 4 shows an example of the evaporator coil 212 in greater detail with thermistors 252 and 254 disposed on different portions of the evaporator coil 212. Each thermistor 252 and 254 may be attached to or disposed on the evaporator coil 212 via any appropriate means (e.g., attached to an internal or exterior surface of the coil 206). The first thermistor 252 is disposed on or near a first portion 402 of the evaporator coil 212 with a refrigerant flowing therethrough at the saturation temperature of the refrigerant (e.g., a saturated liquid or saturated vapor refrigerant). For example, the first thermistor 252 may be placed at or near an initial or entry section 402 of evaporator coil 212 (i.e., before sufficient heat transfer has occurred to superheat the refrigerant). For instance, the first thermistor 252 may be positioned within a predetermined distance (e.g., of about 0 to about 36 inches) from the inlet 406 of the evaporator coil 406. The second thermistor 254 is disposed on or near a second portion 404 of the evaporator coil 212 with superheated vapor refrigerant flowing therethrough. For example, the second thermistor 254 may be placed at or near the outlet 408 of the evaporator coil 212 (e.g., near the outlet leading towards the compressor 204). For instance, the second thermistor 254 may be placed within a predefined distance (e.g., of about 0 to about 36 inches) from the outlet 308 of the evaporator coil 212. The expansion device 210 may be coupled to a flow rate sensor 410 that monitors the rate of refrigerant flow through the evaporator coil 212.

The second thermistor 254 is generally coupled electronically to a supply voltage (e.g., corresponding to voltage 106 in FIG. 1), while a signal output (e.g., corresponding to signal output 108 in FIG. 1) is communicatively coupled to the controller 234 between the terminals (i.e., corresponding to terminals 112 and 114 of FIG. 1) of the first and second thermistors 252 and 254. The signal 256 transmitted to the controller 234 is referred to herein as a "superheat signal," and may be used to determine one or both of (1) the difference between the temperature of superheated vapor refrigerant in the evaporator coil 212 (e.g., the "suction temperature") and the saturation temperature of the refrigerant flowing through the evaporator coil 212 (e.g., the "saturated suction temperature") and (2) whether a loss of charge has or may have occurred in the HVAC system (e.g., as described in greater detail with respect to FIG. 5 below).

Referring again to FIG. 2, the expansion device 210 for removing pressure from the refrigerant is coupled to the refrigerant conduit subsystem 246 downstream of the condenser 206. In this way, the refrigerant is delivered to the evaporator coil 212 at a reduced pressure. The expansion device 210 may, for example, be a valve such as an expansion valve or a flow control valve (e.g., a TXV valve) or any other suitable valve for removing pressure from the refrigerant while providing control of the rate of flow of the refrigerant.

A portion of the HVAC system 200 is configured to move airflow 214 across the evaporator coil 212 and out of the duct sub-system 218 as airflow 216. Return airflow 220, which may include air returning from the building, fresh air from outside, or some combination, is pulled into a return duct 222. A suction side of a blower 224 pulls the return airflow 220. The blower 224 discharges airflow 214 into a duct 226 from where the airflow 214 crosses the evaporator coil 212 or heating elements (not shown) to produce the conditioned airflow 216. The blower 224 is any mechanism for providing a flow of air through the HVAC system 200. For example, the blower 224 may be a constant-speed or variable-speed circulation blower or fan. Examples of a variable-speed blower 224 include, but are not limited to, belt-drive blowers controlled by inverters, direct-drive blowers with electronic commuted motors (ECM), or any other suitable types of blowers.

The blower 224 is in signal communication with the controller 234 using any suitable type of wired or wireless connection 228. The controller 234 is configured to provide commands or signals to the blower 224 to control its operation. For example, the controller 234 may be configured to send signals to the blower 224 to control the fan speed of the variable-speed blower 224. In some embodiments, the controller 234 may be configured to send other commands or signals to the blower 224 to control any other functionality of the blower 224. In some embodiments, the controller is configured to facilitate adjustment and/or optimization of the operation of the blower 224 based signals from one or both of the first temperature difference sensor 260 and second temperature difference sensor 250.

The HVAC system 200 comprises one or more sensors 240 in signal communication with the controller 234. The sensors 240 may comprise any suitable type of sensor for measuring air temperature as well as other properties of a conditioned space (e.g. a room or building). The sensors 240 may be positioned anywhere within the conditioned space and/or the HVAC system 200. For example, the HVAC system 200 may comprise a sensor 240 positioned and configured to measure an outdoor air temperature. As another example, the HVAC system 200 may comprise a sensor 240 positioned and configured to measure a supply or treated air temperature and/or a return air temperature. In other examples, the HVAC system 200 may comprise sensors 240 positioned and configured to measure any other suitable type of air temperature (e.g., the temperature of air at one or more locations within the conditioned space). In some embodiments, each of sensors 240 may correspond to a temperature sensing element (e.g., thermistor) of a temperature difference sensor such as the sensor 100 illustrated in FIG. 1. This facilitates measurement of temperature differences in the HVAC system 200. For example, a temperature difference may be measured between conditioned airflow 216 and return airflow 220 based on a single signal transmitted from the temperature difference sensor to controller 234. Such a temperature difference may be used, for example, to tune or optimize the operation of the blower 224, the compressor 204, and/or the fan 208.

The thermostat 242 is generally located within the conditioned space (e.g. a room or building) and is in signal communication with the controller 234 using any suitable type of wired or wireless communications, as shown in FIG. 2. The thermostat 242 may be a single-stage thermostat, a multi-stage thermostat, or any suitable type of thermostat as would be appreciated by one of ordinary skill in the art. The thermostat 242 is configured to allow a user to input a desired temperature or temperature set point 244 for a designated space or zone such as a room in the conditioned space. The controller 234 may use information from the thermostat 242 such as the temperature set point 244 for controlling the compressor 204 and the blower 224.

As described, in certain embodiments, connections between various components of the HVAC system 200 are wired. For example, conventional cable and contacts may be used to couple the controller 234 to the various components of the HVAC system 200, including the blower 224, the compressor 204, the fan 208, the first temperature difference sensor 250, the second temperature difference sensor 260, and sensors 240. In some embodiments, a wireless connection is employed to provide at least some of the connections between components of the HVAC system 200 such as, for example, a connection between controller 234 and the variable-speed circulation fan 208 or any environment sensors 240 of system 200. In some embodiments, a data bus couples various components of the HVAC system 200 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 200 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 234 to other components of the HVAC system 200.

In an example operation of system 200, a subcool signal 266 from first temperature difference sensor 260 is used to monitor the performance of HVAC system 200. During operation of condenser coil 206 it may be beneficial to ensure that refrigerant output to the evaporator coil 212 is entirely in the liquid phase (i.e., that no vapor-phase refrigerant is allowed to enter the evaporator coil 212). The subcool value is measured via the subcool signal 266 received from the first temperature difference sensor 260 (e.g., using a lookup table generated during calibration of the sensor 260) to confirm (e.g., continuously during operation) that an appropriate subcool value is achieved that corresponds to a fully liquid phase refrigerant output from the condenser coil 206. This prevents possible damage to the metering device 210 caused by flow of a vapor phase fluid through the metering device 210. A desired subcool value for optimal condenser coil 206 performance is generally in a range from about 6 to about 10° F. When the subcool value is less than this range, and particularly when the subcool value approaches 0° F., the condenser coil 206 typically may not be performing as intended.

In another example operation of the system 200, a subcool signal 266 from first temperature difference sensor 260 is used to detect a loss of charge in the HVAC system 200 (e.g., to detect a loss or leak of refrigerant from the HVAC system 200). For example, as described in greater detail with respect to method 500 below, the subcool value may be determined by accessing a calibration file (e.g., see TABLE 1 below) for the first temperature difference sensor 250 and identifying a subcool value (e.g., in degrees Fahrenheit) that corresponds to the subcool signal 256 (see TABLE 2 below). The controller 234 then determines whether the measured subcool value is less than a threshold subcool value (e.g., of about 6° F. or less) corresponding to a likely loss of charge. If the measured subcool value is less than or equal to the threshold value, the controller 234 determines that a loss of charge has occurred. The controller 234 may transmit an alert signal 236 to the thermostat 242 indicating this loss of charge. The alert signal may also or alternatively be transmitted to a service center or a device of a service technician such appropriate corrective steps may be taken to repair the system 200.

In another example operation of the HVAC system 200, the subcool signal 266 can be monitored while the HVAC system 200 is charged (e.g., filled) with refrigerant to determine when charging is complete. For example, once a desired subcool value (e.g., of 8° F., or a subcool value in a desired range (e.g., of between about 6 to about 10° F.) has been reached, charging might be considered completed and stopped. Generally, as the charge of refrigerant in the HVAC system 200 is increased, the subcool value increases.

In yet another example operation of HVAC system 200, a superheat signal 256 from second temperature difference sensor 250 is used to monitor the performance of HVAC system 200. For example, the controller 234 may determine a superheat value using the superheat signal 256 received from the superheat sensor 250 and use the superheat value to detect a loss of charge. For example, as described in greater detail with respect to method 500 below, the superheat value may be determined by accessing a calibration file (e.g., a lookup table) for the corresponding temperature difference sensor 250 and identifying a superheat value (e.g., in degrees Fahrenheit) that corresponds to the superheat signal 256 (see TABLE 2 below). A preferred superheat value is in a range from about 8 to 12° F. When the superheat value exceeds a certain temperature threshold (e.g., of greater than about 10 to 20° F.), no additional benefit is provided by the evaporator coil 212 (i.e., no improvement to the performance of system 200 is achieved). To prevent this wasted superheating and the associated waste of energy, the controller 234 may transmit an alert signal 236 to the thermostat 242 when the superheat value exceeds an efficiency threshold (e.g., of about 10 to 20° F.).

If the superheat value exceeds a maximum threshold (e.g., of about 20 to 30° F.) or the subcool value is less than a minimum threshold (e.g., 2° F.), the HVAC system 200 likely requires immediate attention. In some embodiments, the controller 234 is operable to automatically shut down when the superheat value exceeds the maximum superheat threshold or the subcool value is less than the minimum threshold to prevent damage to the HVAC system 200 or unnecessary expenditure of energy when the system 200 is not functioning properly. In some embodiments, the superheat value may be used to diagnose other performance issues of the HVAC system 200. For example, the superheat value may be monitored over time for gradual loss of charge or leak detection. For example, a relatively slow drift in the superheat value over time may be indicative of a slow leak of refrigerant form the system 200. In some embodiments, subcool value is monitored as a first measure of loss of charge, and superheat is monitored as a secondary measure. This is because when loss of charge occurs, the subcool value generally first goes to 0° F. before the superheat value begins to increase.

In another example operation of the HVAC system 200, a subcool signal 266 from sensor 260 and/or a superheat signal 256 from sensor 250 is used to optimize performance of the overall HVAC system 200. For example, measured subcool values and/or superheat values may be used to adjust the speed of one or more of the compressor 204, the fan 208, and the blower 224 to improve system performance. For example, if the controller 234 determines that the subcool value is lower than a performance threshold (e.g., of about 6° F.), the controller 234 may cause the speed of the fan 208 to increase in order to provide more cooling to the refrigerant passing through the condenser coil 206. For example, the speed of the fan 208 may be increased by a predetermined amount (e.g., corresponding to a speed increase of about 10%) or an amount proportional to the difference between the measured subcool value and a target subcool value (e.g., of 6° F.). After the speed of the fan 208 is increased, the subcool value will continue to be monitored to determine if further adjustment in the speed of fan 208 is needed to reach the target subcool value. A similar approach may be used to adjust the speed of the blower 224 and/or the compressor 204 to obtain a target subcool value, based on the subcool signal 266. Similarly, if the controller 234 determines that the superheat value is greater than a performance threshold (e.g., of about 10° F.), the controller 234 may determine that further heating of the refrigerant in the evaporator coil is not required and cause the speed of the blower 208 to decrease to conserve energy. The speed of the blower 208 may be decreased by a predetermined amount (e.g., of about 10%) or an amount proportional to the difference between the measured superheat value and the performance threshold value. For example, the speed of the compressor 208 may be decreased gradually until the superheat value is equal to or less than the performance threshold.

It should be understood that the temperature difference sensors described in the present disclosure are not limited to measuring refrigerant temperature differences in the condenser coil 206 and evaporator coil 212. One or more additional or alternate temperature difference sensors may be employed to measure any relevant temperature difference in the HVAC system 200 such as the temperature difference between return airflow 220 and conditioned airflow 216, which can also be used to monitor and optimize the performance of the HVAC system 200.

Example Method of Operation

Figure 5:
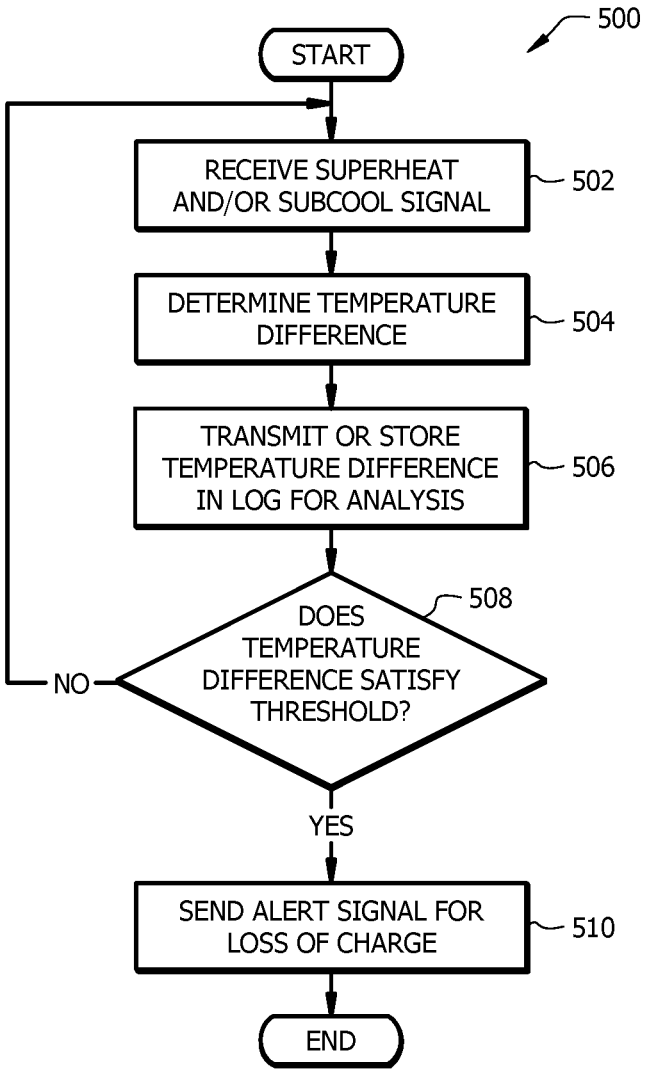
FIG. 5 is a flowchart of an example method for detecting charge loss for the HVAC system illustrated in FIG. 2.

FIG. 5 is a flowchart of a method 500 for detecting loss of charge in HVAC system 200 using temperature difference sensors such as the subcool sensor 260 and/or the superheat sensor 250 shown in FIG. 2.

At step 502, the controller 234 of HVAC system 200 receives a signal from temperature difference sensor 250 and/or 260. For instance, a subcool signal 266 may be received from subcool sensor 260 disposed on the condenser coil 206 of the HVAC system 200, and a superheat signal 256 may be received from superheat sensor 250 disposed on the evaporator coil 212 of the HVAC system 200.

At step 504, the controller 234 determines one or more temperature differences based on the received signal(s) from step 502. Each temperature difference may be determined for example by accessing a calibration file (e.g., a lookup table) for the corresponding temperature difference sensor 250 or 260 and identifying a temperature difference (e.g., in degrees Fahrenheit) that corresponds to the received signal. An example of the information included in a calibration file (e.g., a lookup table) for measuring a subcool value is shown in TABLE 1. As shown in TABLE 1, the subcool value generally increases with an increase in the subcool signal 266. An example of the information included in a calibration file for measuring a superheat value is shown in TABLE 2. Like the calibration information of TABLE 1, the superheat value generally increases with an increase in the superheat value 256. As shown in TABLE 2, the calibration information for the superheat value may include a broader range of temperatures (e.g., from 0 to 50° F.) compared to that of the subcool value (e.g., from 0 to 10° F.), because the superheat value can generally vary more widely during operation of the HVAC system 200.

TABLE 1

Example calibration file information for determining a subcool value.

| Subcool Signal (Volts) | Subcool Value (° F.) |
|---|---|
| 2.5 | 0 |
| 2.56 | 2 |
| 2.621 | 4 |
| 2.682 | 6 |
| 2.743 | 8 |
| 2.805 | 10 |

TABLE 2

Example calibration file information for determining a superheat value.

| Superheat Signal (Volts) | Superheat Value (° F.) |
|---|---|
| 2.5 | 0 |
| 2.667 | 5 |
| 2.848 | 10 |
| 3.014 | 15 |
| 3.173 | 20 |
| 3.324 | 25 |
| 3.465 | 30 |
| 3.598 | 35 |
| 3.721 | 40 |
| 3.853 | 45 |
| 3.6940 | 50 |

The controller 234 may further determine an error or uncertainty associated with the measured temperature difference. For example, the calibration file may include, for each signal value, an associated temperature difference value and a temperature uncertainty value. The uncertainty value may provide supplemental information related to the accuracy of the temperature difference measurement and used to determine whether or to what extent a given measurement should be trusted (e.g., with an uncertainty value that is less than or equal to a threshold value) or not trusted (e.g., with an uncertainty value that is greater than or equal to the threshold value).

At step 506, the controller 234 may transmit the measured temperature difference for storage in a remote memory or store the temperature difference in a local memory (e.g., in a temperature difference log). For example, the controller 234 may access a table comprising previously measured temperature differences in a temperature difference log and add an entry to the table for the measured temperature difference. The entry generally includes a timestamp corresponding to the time when the temperature difference was measured and may also include any supplemental information related to the HVAC system 200 (e.g., a speed of fan 208, a refrigerant flow rate, a speed of compressor 204, a speed of blower 224, etc.). The saved temperature differences may be used for instantaneous determination of properties of system 200 (e.g., for detecting a loss of charge) and for long-term trend analysis (e.g., detecting slow leaks of refrigerant or other performance issues with system 200). For example, a slow decay in a superheat value may correspond to a gradual loss or slow leakage of refrigerant from the HVAC system 200.

At step 508, the controller 234 compares the determined temperature difference to a threshold value and determines whether threshold criteria are satisfied (e.g., whether a measured superheat value is greater than a superheat threshold or a measured subcool value is less than a subcool threshold). For a superheat value, for instance, the controller 234 may determine whether the measured superheat value is greater than a threshold superheat value (e.g., of about 20° F.). As described above, a preferred superheat value is generally in a range from about 8 to 12° F. If the superheat value is less than the threshold value, the system 200 is likely charged correctly, so the controller 234 does not determine that a loss of charge has occurred. In this case, the controller 234 returns to start and receives the next temperature difference signal for analysis. However, if the measured superheat value is greater than or equal to the threshold value, the controller determines that a loss of charge has occurred. At step 510, the controller 234 then proceeds to transmit an alert signal 234 indicating a loss of charge. The alert signal 234 may be sent to a display on the thermostat 242 of the HVAC system 200, so that a user is alerted to the loss of charge. The alert signal 234 may also or alternatively be transmitted to service center or any other appropriate device (e.g., a device of a service technician or a user of the HVAC system 200) such that corrective steps may be initiated to repair the system 200.

For a subcool value, at step 508, the controller 234 may determine whether the measured subcool value is less than a threshold subcool value (e.g., of about 6° F. or less). As described above, a preferred subcool value is generally in a range from about 6 to 10° F. If the subcool value is greater than the threshold value, the system 200 is likely charged correctly, so a loss of charge is not detected by the controller 234. In this case, the controller 234 returns to start and receives the next temperature difference signal for analysis. However, if the measured sub cool value is less than or equal to the threshold value, the controller 234 determines that a loss of charge has occurred. The controller 234 then proceeds to transmit an alert signal 234 indicating a loss of charge, at step 510. The alert signal 234 may be sent to a display on the thermostat 242 of the HVAC system 200, so that a user is alerted to the loss of charge. The alert signal 234 may also or alternatively be transmitted to service center or any other appropriate device (e.g., device of a service technician or a user of the HVAC system) such that corrective steps may be initiated to repair the system 200.

Modifications, additions, or omissions may be made to method 500 depicted in FIG. 5. Method 500 may include more, fewer, or other steps. For example, steps may be performed in parallel or in any suitable order. While at times discussed as HVAC system 200 (or components thereof) performing the steps, any suitable HVAC system or components of an HVAC system may perform one or more steps of the method.

Controller

Figure 6:
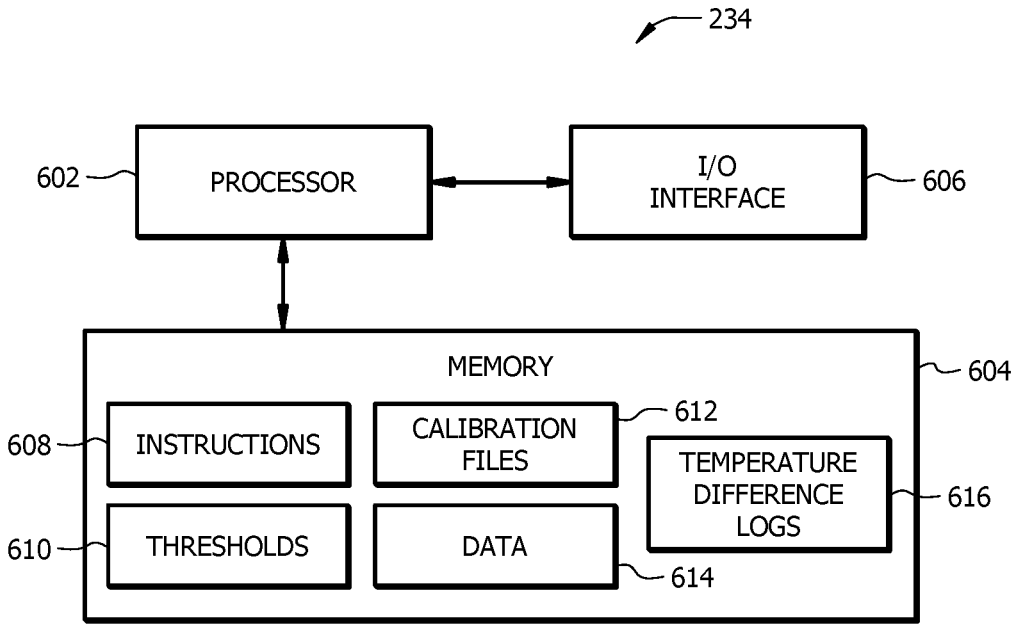
FIG. 6 is a diagram of an example controller of the HVAC system illustrated in FIG. 2.

FIG. 6 is a schematic diagram of an embodiment of a controller 234 for use with the HVAC system 200. The controller 234 comprises a processor 602, a memory 604, and an input/output (I/O) interface 606. The processor 602 comprises one or more processors operably coupled to the memory 604. The processor 602 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 604 and controls the operation of the HVAC system and the temperature difference sensor.

The processor 602 may be a programmable logic device, a microcontroller, a microprocessor, or any suitable combination of the preceding. The processor 602 is communicatively coupled to and in signal communication with the memory 604. The one or more processors 602 are configured to process data and may be implemented in hardware or software. For example, the processor 602 may be 8-bit, 16-bit, 32-bit, 64-bit or of any other suitable architecture. The processor 602 may include an arithmetic logic unit (ALU) for performing arithmetic and logic operations, processor 602 registers that supply operands to the ALU and store the results of ALU operations, and a control unit that fetches instructions from memory 604 and executes them by directing the coordinated operations of the ALU, registers, and other components. The processor 602 may include other hardware and software that operates to process information, control the HVAC system 200 of FIG. 2, and perform any of the functions described herein (e.g., with respect to FIG. 5). The processor 602 is not limited to a single processing device and may encompass multiple processing devices. Similarly, the controller 234 is not limited to a single controller but may encompass multiple controllers.

The processor 602 is configured to implement various instructions. For example, the processor 602 may be configured to execute instructions to implement the functions described above with respect to method 500. For example, the processor 602 may be configured to receive a signal from a temperature difference sensor (e.g., a superheat signal 256 and/or a subcool signal 266), compare the signal to a corresponding threshold value, and, based on this comparison, determine whether a loss of charge has occurred for the HVAC system 200.

The memory 604 comprises one or more disks, tape drives, or solid-state drives, and may be used as an over-flow data storage device, to store programs when such programs are selected for execution, and to store instructions 608 and data 614 that are read during program execution. The memory 604 may be volatile or non-volatile and may comprise ROM, RAM, ternary content-addressable memory (TCAM), dynamic random-access memory (DRAM), and static random-access memory (SRAM). The memory 604 is operable to store thresholds 610, calibration files 612, temperature difference logs 616, and any other data 614 or instructions 608. The instructions 608 comprise any suitable set of instructions, logic, rules, or code operable to execute functions described herein. The data 614 includes any other information stored within the memory 604 for use by the controller 234.

The thresholds 610 generally include threshold values corresponding to a condition of interest (e.g., a loss of charge) in the HVAC system. For example, the thresholds 610 may include a superheat threshold and a subcool threshold. If a superheat value is determined to be greater than the superheat threshold, the processor 602 generally determines that a loss of charge has occurred. Likewise, if a subcool value is determined to be less than the subcool threshold, the processor 602 determines that a loss of charge has occurred.

The calibration files 612 generally include one or more databases of predetermined temperature difference values corresponding to measured temperature difference signals from the temperature difference sensors 250 and 260. This calibration information may be stored in any appropriate format such as in one or more tables. For example, the superheat sensor 250 may be calibrated for superheat measurement by measuring the temperature difference signal (e.g., in units of volts) at different temperature conditions (e.g., with the first and second thermistors exposed to different known temperatures). The calibration files 612 may also include predetermined error or accuracy information for these values. This supplemental information may allow the processor 602 to determine a confidence level for measured temperature differences.

The temperature difference logs 616 generally include one or more databases of information, stored in an appropriate format, for temperature differences measured over time. The temperature difference logs 616 may be analyzed by the processor 602 or exported for external review. Trends in the historical temperature difference measurements may, in certain embodiments, be helpful for diagnosing problems associated with the HVAC system 200. For example, a gradual loss of charge may be identified from a slow drift in a temperature difference value over an extended period of time (e.g., of days, weeks, or months).

The I/O interface 606 is configured to communicate data and signals with other devices. For example, the I/O interface 606 may be configured to communicate electrical signals with the temperature difference sensors 250 and 260, the compressor 204, the blower 224, and the fan 208. The I/O interface may receive, for example, superheat signals 256, subcool signals 266, other temperature difference signals, thermostat calls, temperature setpoints, blower control signals, environmental conditions, and an operating mode status for the HVAC system and send electrical signals to the blower, compressor, and fan to control operation thereof. The I/O interface 606 may use any suitable type of communication protocol to communicate with the components of the HVAC system. The I/O interface 606 may comprise ports or terminals for establishing signal communications between the controller and other devices. The I/O interface 606 may be configured to enable wire and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A system comprising:

a condenser coil comprising:

an inlet for flow of refrigerant into the condenser coil, an outlet for flow of refrigerant out of the condenser coil, and a subcool sensor, wherein the subcool sensor comprises:

a first thermistor positioned to sense a saturated liquid temperature of the refrigerant flowing in a first portion of the condenser coil, the first thermistor comprising a voltage supply input coupled electronically to a voltage source and a terminal coupled electronically to a terminal of a second thermistor;

the second thermistor positioned to sense a liquid temperature of the refrigerant flowing in a second portion of the condenser coil, the second thermistor coupled electronically to an electronic ground and in series with the first thermistor; and a signal output configured to transmit a subcool signal from the subcool sensor, wherein the signal output is coupled electronically to the terminal of the first thermistor and the terminal of the second thermistor between the first thermistor and second thermistor coupled electronically in series, wherein the subcool signal scales with a ratio of a first temperature-dependent resistance of the first thermistor and a second temperature-dependent resistance of the second thermistor; and a controller comprising an input/output interface configured to receive the subcool signal from the subcool sensor, wherein the controller is configured to determine a temperature difference between the saturated liquid temperature and the liquid temperature based on the subcool signal.

2. The system of claim 1, wherein the controller is further configured to determine, based on one or both of the subcool signal and the determined temperature difference, a charge state of a heating, ventilation and air conditioning (HVAC) system associated with the condenser coil.

3. The system of claim 1, wherein the first portion of the condenser coil contains the refrigerant at a saturation temperature of the refrigerant.

4. The system of claim 1, wherein the second portion of the condenser coil contains the refrigerant in a subcooled liquid state.

5. The system of claim 1, wherein the second portion of the condenser coil is within a predefined distance from the outlet of the condenser coil.

6. The system of claim 1, wherein the controller is further configured to:

detect, based on one or both of the subcool signal and the determined temperature difference, whether a loss of charge has occurred in an HVAC system associated with the condenser coil; and transmit an alert signal for the detected loss of charge.

7. The system of claim 1, wherein the controller is further configured to determine, based on one or both of the subcool signal and the determined temperature difference, a predefined speed for one or more of a variable speed compressor, a variable speed blower, and a variable speed outdoor fan of an HVAC system associated with the condenser.

8. The system of claim 1, wherein the controller is configured to determine the temperature difference based on the subcool signal.

9. A system comprising:

an evaporator coil comprising:

an inlet for flow of refrigerant into the evaporator coil, an outlet for flow of refrigerant out of the evaporator coil, and a superheat sensor, wherein the superheat sensor comprises:

a first thermistor positioned to sense a saturated suction temperature of the refrigerant flowing in a first portion of the evaporator coil, the first thermistor comprising a voltage supply input coupled electronically to a voltage source and a terminal coupled electronically to a terminal of a second thermistor;

the second thermistor positioned to sense a superheated vapor temperature of the refrigerant flowing in a second portion of the evaporator coil, the second thermistor coupled electronically to an electronic ground and in series with the first thermistor; and a signal output configured to transmit a superheat signal from the superheat sensor, wherein the signal output is coupled electronically to the terminal of the first thermistor and the terminal of the second thermistor between the first thermistor and second thermistor coupled electronically in series, wherein the superheat signal scales with a ratio of a first temperature-dependent resistance of the first thermistor and a second temperature-dependent resistance of the second thermistor; and a controller comprising an input/output interface configured to receive the superheat signal from the superheat sensor, wherein the controller is configured to determine a temperature difference between the saturated suction temperature and the superheated vapor temperature based on the superheat signal.

10. The system of claim 9, wherein the controller is further configured to determine, based on one or both of the superheat signal and the determined temperature difference, a charge state of a heating, ventilation and air conditioning (HVAC) system associated with the evaporator coil.

11. The system of claim 9, wherein the first portion of the evaporator coil contains the refrigerant in a saturated liquid or saturated vapor state.

12. The system of claim 9, wherein the second portion of the evaporator coil contains the refrigerant at a saturation temperature of the refrigerant.

13. The system of claim 9, wherein the second portion of the condenser coil is within a predefined distance from the outlet of the evaporator coil.

14. The system of claim 9, wherein the controller is further configured to:

detect, based on one or both of the superheat signal and the determined temperature difference, whether a loss of charge has occurred in an HVAC system associated with the condenser; and transmit an alert signal for the detected loss of charge.

15. The system of claim 9, wherein the controller is further configured to determine, based on one or both of the superheat signal and the determined temperature difference, a predefined speed for one or more of a variable speed compressor, a variable speed blower, and a variable speed outdoor fan of an HVAC system associated with the evaporator coil.

16. The system of claim 9, wherein the controller is configured to determine the temperature difference based on the superheat signal.

17. A system comprising:

a condenser coil comprising:

a condenser inlet for flow of refrigerant into the condenser coil, a condenser outlet for flow of the refrigerant out of the condenser coil, and a subcool sensor, wherein the subcool sensor comprises:

a first condenser thermistor positioned to sense a first condenser temperature of the refrigerant flowing in a first portion of the condenser coil;

a second condenser thermistor positioned to sense a second condenser temperature of the refrigerant flowing in a second portion of the condenser coil, the second condenser thermistor coupled electronically in series with the first condenser thermistor, wherein the first condenser thermistor and second condenser thermistor are coupled in series via electronic connection of a terminal of the first condenser thermistor to a terminal of the second condenser thermistor; and a condenser signal output configured to transmit a subcool signal from the subcool sensor, wherein the condenser signal output is coupled electronically to the terminal of the first condenser thermistor and the terminal of the second condenser thermistor between the first condenser thermistor and the second condenser thermistor coupled electronically in series, wherein the subcool signal scales with a ratio of a first temperature-dependent resistance of the first condenser thermistor and a second temperature-dependent resistance of the second condenser thermistor; and an evaporator coil comprising:

an evaporator inlet for flow of the refrigerant into the evaporator coil, an evaporator outlet for flow of the refrigerant out of the evaporator coil, and a superheat sensor, wherein the superheat sensor comprises:

a first evaporator thermistor positioned to sense a first evaporator temperature of the refrigerant flowing in a first portion of the evaporator coil;

a second evaporator thermistor positioned to sense a second evaporator temperature of the refrigerant flowing in a second portion of the evaporator coil, the first evaporator thermistor coupled electronically in series with the second evaporator thermistor, wherein the first evaporator thermistor and the second evaporator thermistor are coupled in series via electronic connection of a terminal of the first evaporator thermistor to a terminal of the second evaporator thermistor; and an evaporator signal output configured to transmit a superheat signal from the superheat sensor, wherein the evaporator signal output is coupled electronically to the terminal of the first evaporator thermistor and the terminal of the second evaporator thermistor between the first evaporator thermistor and the second evaporator thermistor coupled electronically in series wherein the superheat signal scales with a ratio of a first temperature-dependent resistance of the first evaporator thermistor and a second temperature-dependent resistance of the second evaporator thermistor; and a controller comprising an input/output interface configured to receive the subcool signal from the subcool sensor and the superheat signal from the superheat sensor, wherein the controller is configured to:

determine a subcool temperature difference between the first condenser temperature and the second condenser temperature based on the subcool signal; and determine a superheat temperature difference between the first evaporator temperature and the second evaporator temperature based on the superheat signal.

18. The system of claim 17, wherein the controller is further configured to determine, based on one or both of the superheat signal and the determined superheat temperature difference, a charge state of a heating, ventilation and air conditioning (HVAC) system associated with the condenser coil and the evaporator coil.

19. The system of claim 17, wherein the controller is further configured to:

detect, based on one or both of the superheat signal and the determined superheat temperature difference, whether a loss of charge has occurred in one or both of the condenser coil and the evaporator coil; and transmit an alert signal for the detected loss of charge.

20. The system of claim 17, wherein the controller is further configured to determine, based on one or both of the determined subcool temperature difference and the determined superheat temperature difference, a predefined speed for one or more of a variable speed compressor, a variable speed blower, and a variable speed outdoor fan of an HVAC system associated with the condenser coil and the evaporator coil.

* * * * *